United States Patent [19]

Shaffer et al.

[11] 4,144,513

[45] Mar. 13, 1979

[54] ANTI-REBOUND LATCH FOR CURRENT LIMITING SWITCHES

[75] Inventors: Howard R. Shaffer, Westminster; G. Erich Heberlein, Jr., Sykesville; Norman P. Perkins, Westminster, all of Md.

[73] Assignee: Gould Inc., Rolling Meadows, Ill.

[21] Appl. No.: 825,584

[22] Filed: Aug. 18, 1977

[51] Int. Cl.[2] ..... H01H 77/00

[52] U.S. Cl. ..... 335/46; 335/16

[58] Field of Search ..... 335/46, 157, 158, 193, 335/271, 277, 16

[56] References Cited

U.S. PATENT DOCUMENTS

| | | | |
|---|---|---|---|
| 3,518,587 | 6/1970 | Huggins | 335/46 |
| 3,815,059 | 6/1974 | Spoelman | 335/16 |

*Primary Examiner*—Harold Broome

*Attorney, Agent, or Firm*—Ostrolenk, Faber, Gerb & Soffen

[57] ABSTRACT

A multipole circuit breaker is constructed with a single rod pivotally mounting all of the movable contact arms to a common one piece molded insulating carrier. Individual torsion springs engage each of the contact arms to provide contact pressure when the circuit breaker is closed. The construction of the contact arms and carrier are such that under severe overcurrent conditions electrodynamic blowoff forces acting on the contact arms may bring about contact separation that is substantially as great as the contact separation that takes place when the circuit breaker is opened normally by its contact operating mechanism. An individual anti-rebound pin for each pole engages the contact arm of the associated pole to prevent rebound reclosing after electrodynamic opening. A camming means on the carrier releases the anti-rebound latches to permit manual closing of the contacts.

8 Claims, 14 Drawing Figures

FIG. 4.
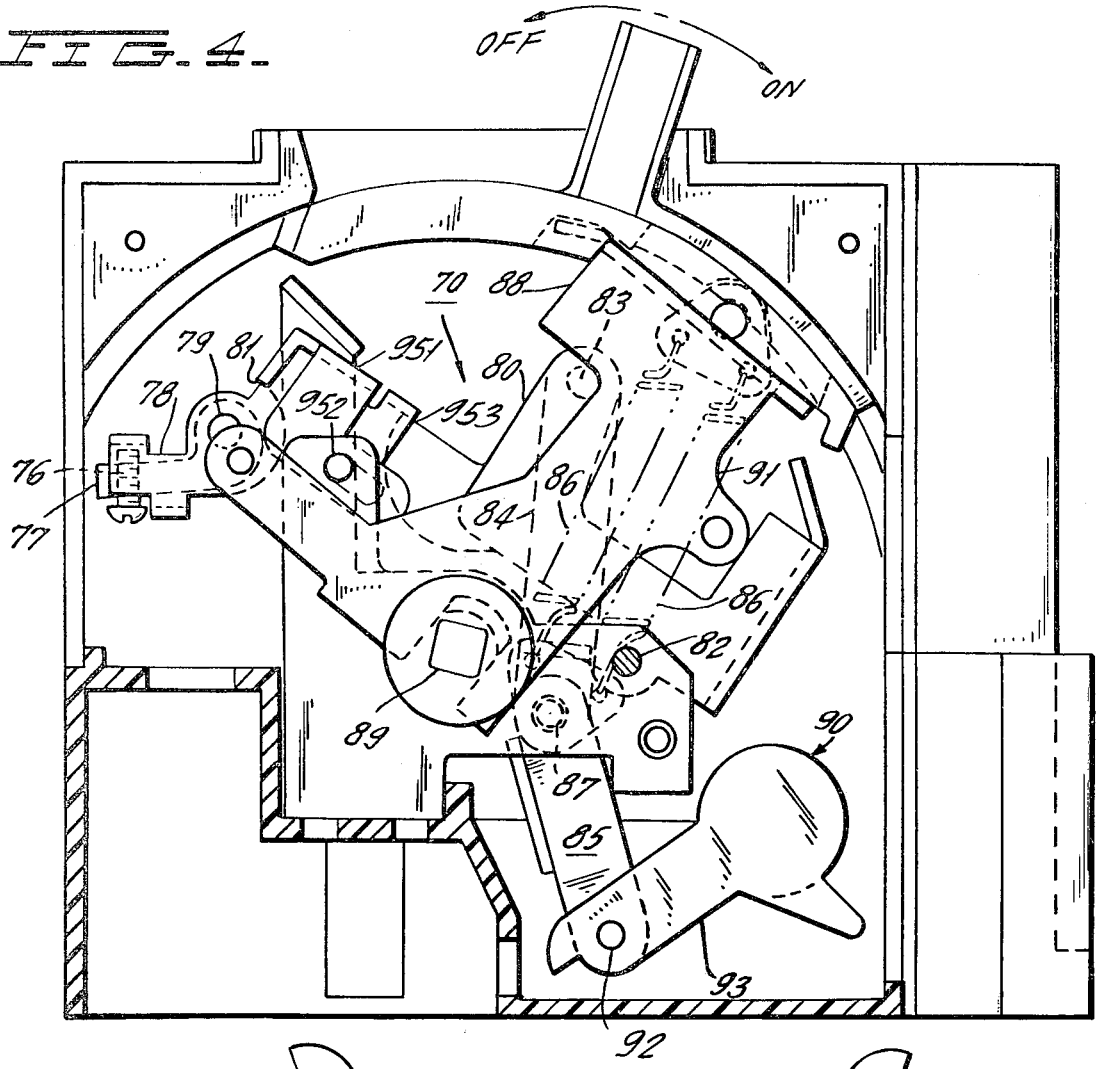
FIG. 10.
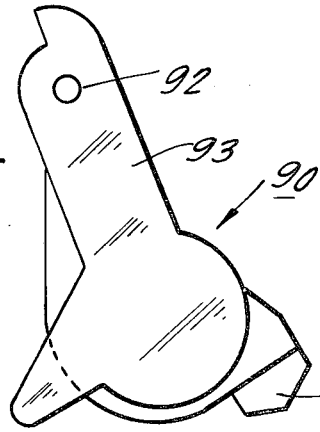
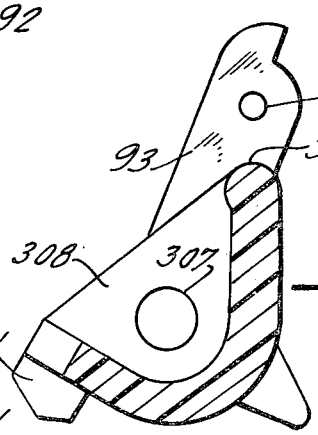
FIG. 9.
FIG. 8.
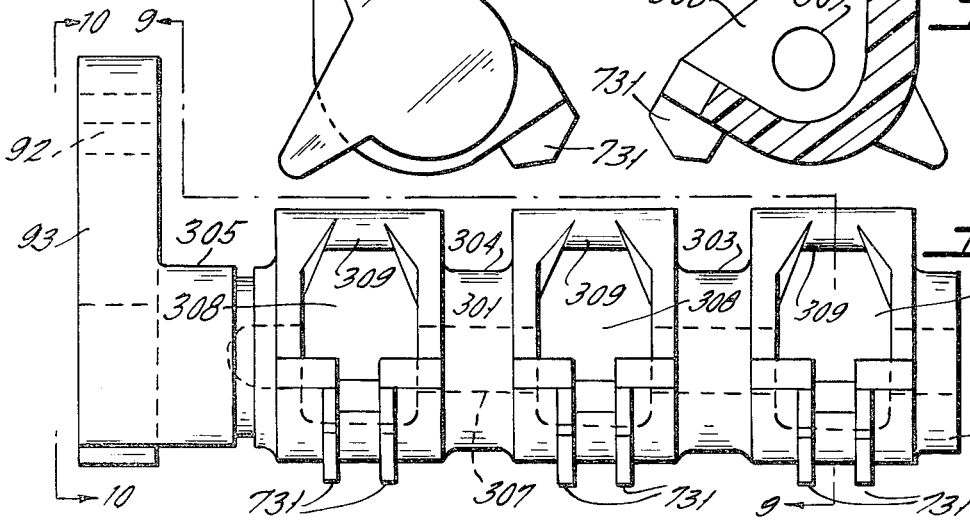

ANTI-REBOUND LATCH FOR CURRENT LIMITING SWITCHES

This invention relates to multi-pole circuit breakers in general and more particularly relates to a current limiting breaker having anti-rebound means.

Some prior art circuit breakers have been constructed so that under severe short current conditions, prior to movement of the contact by its spring-powered operating mechanism, electromagnetic blowoff forces cause contact separation. This contact blow-off has the effect of limiting current to a value that may be safely interrupted by the switch. The larger the contact separation resulting from electrodynamic blowoff effects, the greater the effectiveness of the current limiting action. However, the larger the contact separation due to blow-off effects the greater is the likelihood of contact rebound toward closed circuit position thereby interfering with current interruption.

In accordance with the instant invention, the foregoing problem is solved by providing an individual latch pin for each contact arm biased toward latching position to engage directly and hold the individual arms against rebounding toward closed circuit position. The contact arms are mounted to a carrier having camming formations to release the latches to permit closing of the contacts by the operating mechanism.

Accordingly, a primary object of the instant invention is to provide a novel construction of an anti-rebound means for the contacts of a multipole circuit breaker.

Another object is to provide an anti-rebound means of this type constructed to permit contact separation resulting from electrodynamic effects to be substantially as great as contact separation resulting from a spring powered contact operating mechanism.

Still another object is to provide anti-rebound means of this type comprising an individual subassembly for each pole of the circuit breaker.

A further object is to provide an anti-rebound means of this type that is released by means on the contact carrier when the latter is operated to contact open position.

These objects as well as other objects of this invention shall become readily apparent after reading the following description of the accompanying drawings in which:

FIG. 4 is a cross-section taken through line 4—4 of FIG. 1 looking in the direction of arrows 4—4 and showing the elements of the manual operating mechanism for the circuit breaker portion.

FIG. 8 is a plan view of the one piece contact carrier.

FIG. 9 is a cross-section taken through line 9—9 of FIG. 8 looking in the direction of arrows 9—9.

FIG. 10 is an end view of a contact carrier looking in the direction of arrows 10—10 of FIG. 8.

Figures 11, 12, 13, 14:
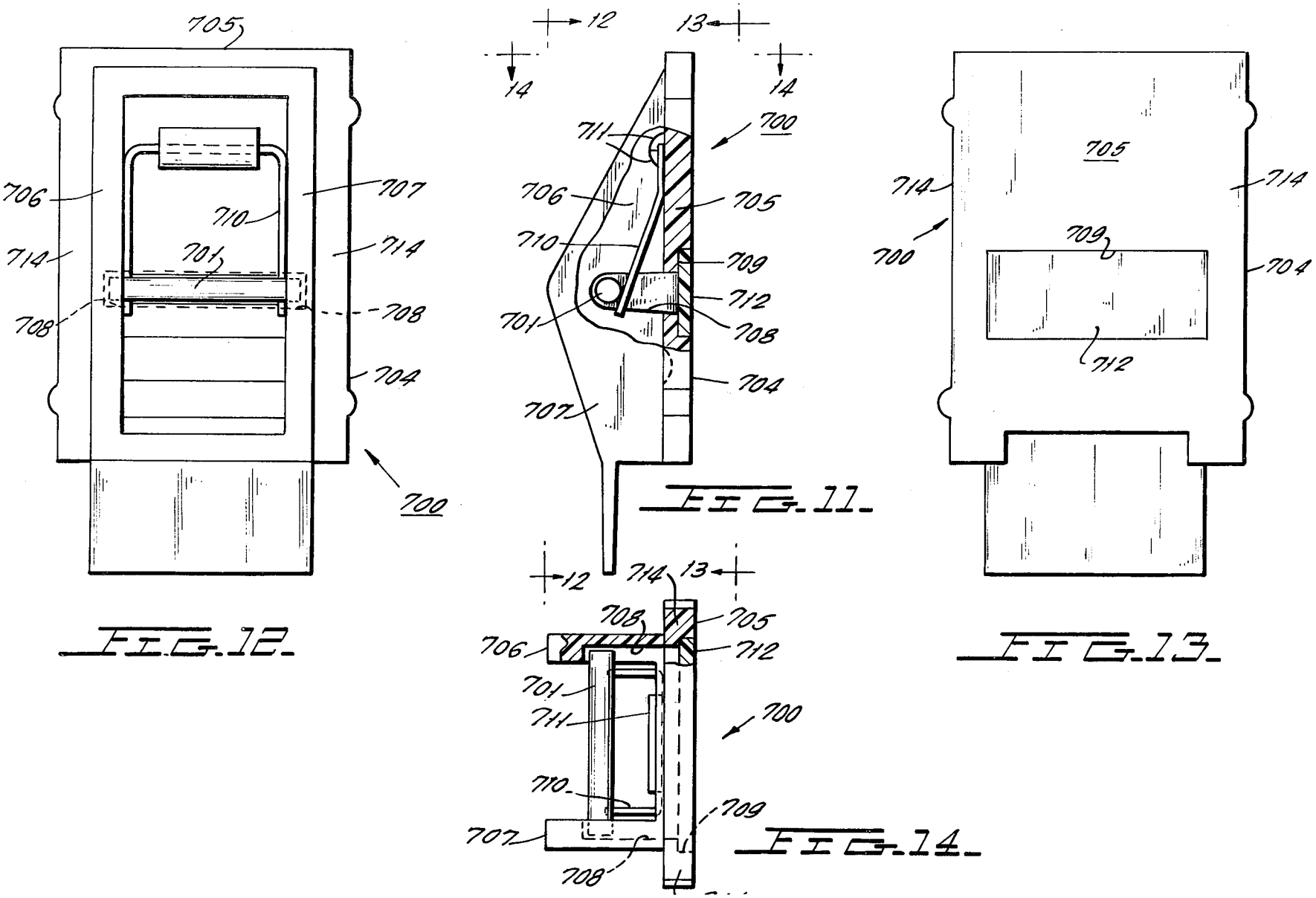
FIG. 11 is a side elevation, partially sectioned, of an anti-rebound latch assembly.

FIGS. 12, 13, and 14 are additional elevations of the anti-rebound latch assembly looking in the directions of the respective arrows 12—12, 13—13 and 14—14 of FIG. 11.

Now referring to the Figures. Unitized combination motor starter 20 includes a molded insulating housing consisting of base 21, case 299 secured to the front of base 21, and removable shallow front cover 22 secured to case 299 by screws 19. Case 299 included longitudinally extending parallel ribs that mate with similar ribs 24, 25, 26 in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for a compartment which houses spring powered trip free contact operating mechanism 70 of FIG. 4.

Figure 2:
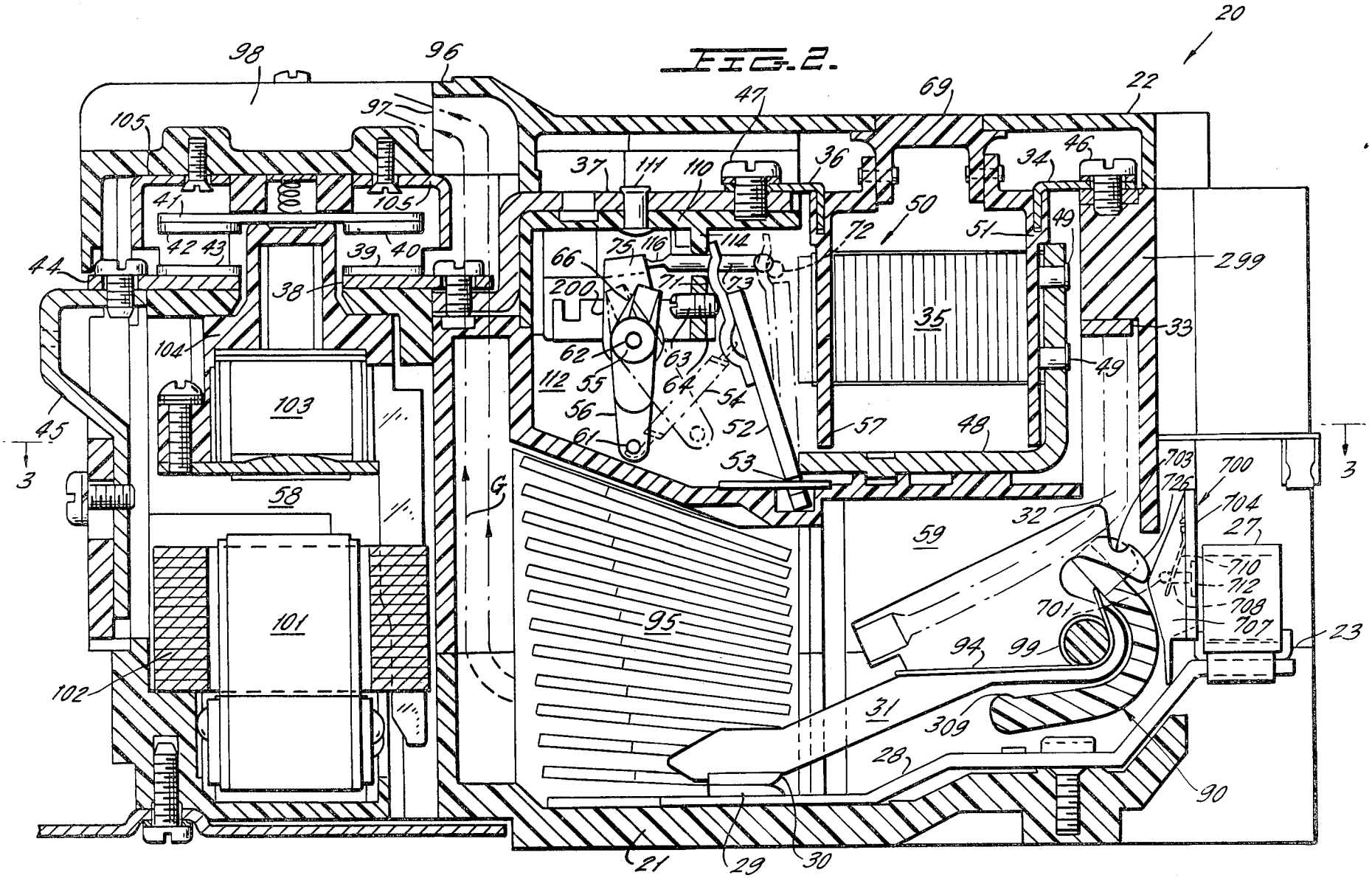
FIG. 2 is a cross-section taken through line 2—2 of FIG. 1 looking in the direction of arrows 2—2 and showing the elements of one pole unit with its contacts closed.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Figure 1:
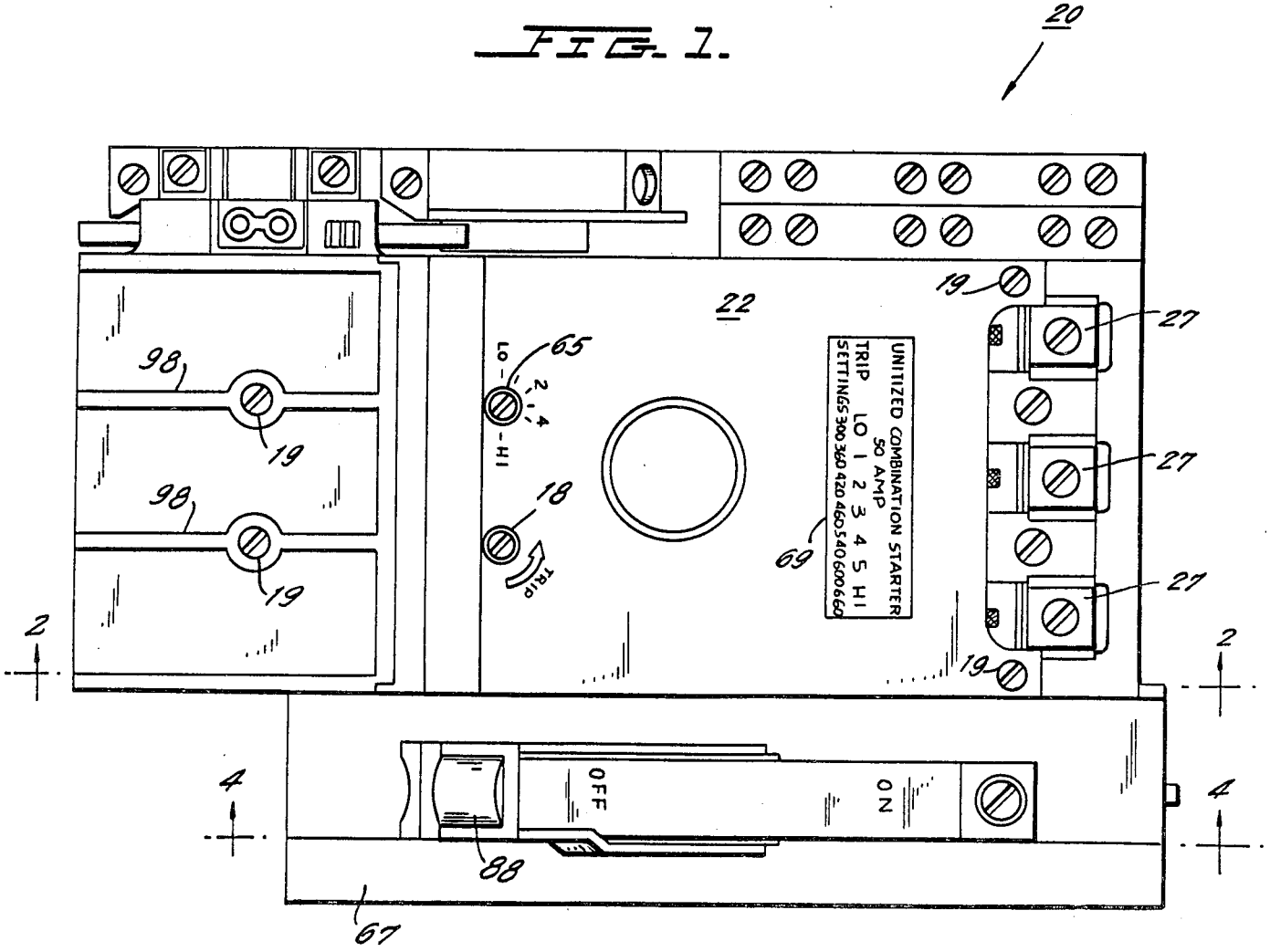
FIG. 1 is a plan view of a unitized combination motor starter including anti-rebound means constructed in accordance with teachings of the instant invention.

Coil 35 is part of circuit breaker calibrating assembly 50 removable and replaceable from the front of starter 20 after front cover 22 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from case 299. Coil 35 is wound about bobbin 57 through which one leg of stationary C-shaped magnetic frame 48 extends. Frame 48 is secured by rivets 49, 49 to bobbin end 51 which mounts terminal 34. The other end of bobbin 57, mounts terminal 36. The magnetic frame also includes movable armture 52 which is pivotally mounted at its lower end in the region indicated by reference numeral 53 so that the upper end of armature 52 may move toward and away from stationary frame portion 48. Coiled tension spring 54 is connected to pin formation 61 at the edge of radial adjusting bar 55 remote from pins 62 about which bar 55 pivots. Thus, spring 54 biases the forward end of armature 52 away from magnetic frame 48.

The air gap adjustment between armature 52 and frame 48 is set by screw 63 which is threadably mounted to transverse member 64. A cam (not shown) at thr rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement extension aperture (not shown) of auxiliary cover 110 (FIG. 2). Turn-to-trip control 18 extends through and is journalled for movement within aperture 18*a* of auxiliary cover 110. pivot controls 65 and 18 are accessible for operation through apertures in main cover 22.

Upon the occurrence of predetermined fault current conditions the flux generated by current flowing in coil 35 attracts armature 52 to stationary frame 48 and 51 causing bifurcated armature bracket 71 to engage enlarged formation 72 on transverse extension 73 of common tripper bar 75. The latter is part of tripper bar means 200 that pivots clockwise about an axis which coincides with axis 62 for adjusting bar 55 which causes screw 76 on tripper bar extension 77 to pivot latch member 78 in a clockwise or tripping direction about is pivot 79, thereby releasing latching point 81 of latch plate 951 on pivot 952 thereby releasing latching point 953 of cradle 80 so that the latter is free to pivot clockwise about pivot 82. As cradle 80 pivots clockwise, end 83 of upper toggle link 84 moves up and to the right with respect to FIG. 4 permitting coiled tension springs 86, connected between toggle knee 87 and manual operating handle 88 to collapse toggle 84, 85 and move handle 88 to the left, the latter is pivoted about center 89 through a connection between handle 88 and its rearward extension 91.

The lower end of lower toggle link 85 is pivotally connected at 92 to the free end of radial extension 93 of contact carrier 90. Hereinafter, the latter element shall be described in greater detail. Thus, as toggle 84, 85 collapses carrier 90 is pivoted clockwise with respect to FIG. 4 and by so doing moves the contact arms 31 of all three poles to the open circuit position of FIG. 7. It is noted that base 21 and case 299 mate along dividing line 23 so that the reduced diameter bearing portions of contact carrier 90 may be inserted and captured in operative positions. In the closed position of circuit breaker portion 59 and individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22, 299 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet III (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73. The latter is flexibly mounted on trip bar 75 at resilient reduced cross-section area 116 which is constructed to bias extension 73 forward.

Contact carrier 90, shown in detail in FIG. 8 through 10, is a one piece unit molded of plastic material and includes a main elongated section 301 which extends transverse to contact arms 31 through the housing compartments for all three poles of circuit breaker portion 59. Main section 301 is provided with two spaced bearing portions 302, 305 which define a pivot axis for carrier 90. Radial extension 93 is disposed at one end of carrier 90 adjacent to bearing portion 305. Circular bore or aperture 307, positioned along the pivot axis for carrier 90, extends from the end of main section 301 opposite extension 93 to bearing 305.

Longitudinally spaced regions 303, 304 of carrier 90 separate three identical pocket-like locating formations 308 formed in main section 301. The individual contact arms 31 are entered into individual ones of the pockets 308 and are pivotally mounted by insulating rod 99 which extends through bore 307 as well as through clearance apertures in each of the contact arms 31 at portions thereof disposed within pocket 308.

Figure 7:
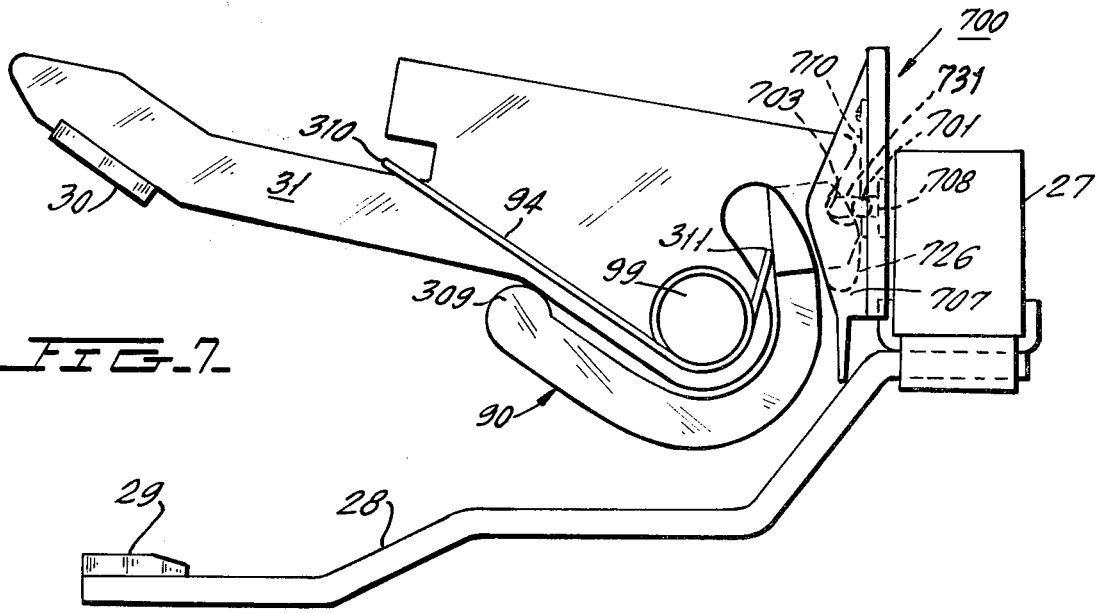
FIG. 7 is a view similar to FIG. 5 showing the contact carrier in reset position.

With contact arm 31 in the open circuit position of FIG. 7 having been operated to this position by contact operating mechanism 70, contact arm 31 abuts surface 309 being held in this position by spring 94. When contacts 29, 30 are engaged, as in FIG. 2, contact arm 31 is spaced slightly from surface 309 so that spring 94 exerts pressure in a closing direction between contacts 29 and 30.

Figure 6:
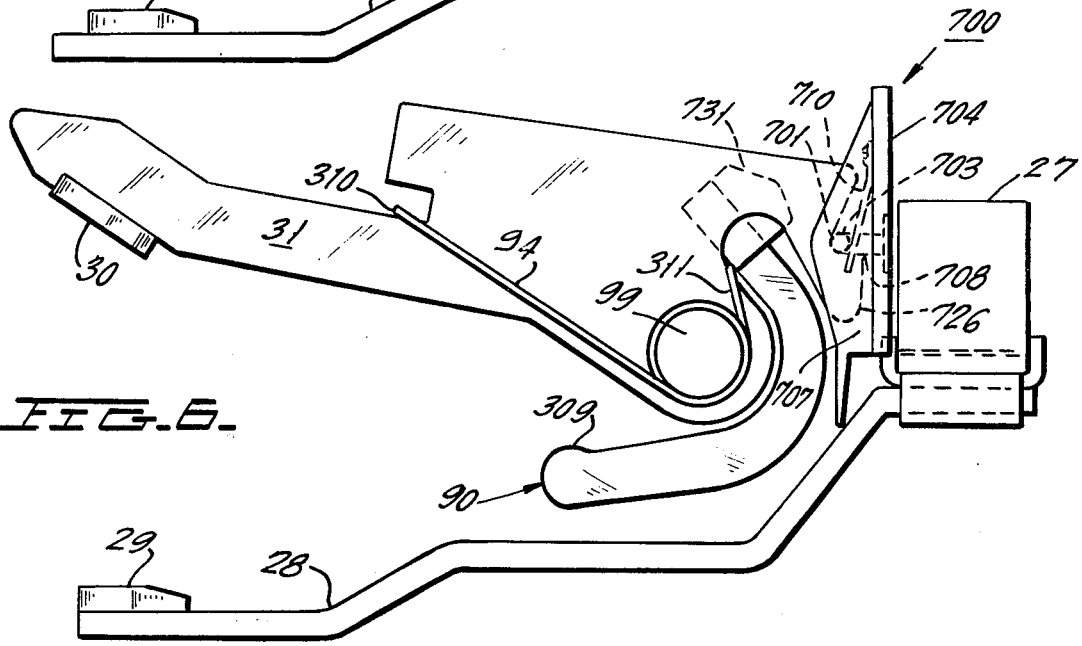
FIG. 6 is a view similar to FIG. 5 showing the movable contact fully separated from the stationary contact by electrodynamic blowoff forces.

Upon the occurrence of severe overload currents, strong electrodynamic blowoff forces are present in that currents flow in opposite directions in the relatively closely spaced contact arm 31 and line terminal strap 28. These electrodynamic forces are in a direction which causes contact arm 31 to pivot clockwise with respect to FIG. 2 even before operating mechanism 70 has moved contact carrier 90 toward the open circuit position of FIG. 7. If these electrodynamic forces are of sufficient strength separation between contacts 29, 30 is, as seen in FIG. 6, essentially the same as that separation obtained through operation of mechanism 70. This large movement of contact arm 31 prior to open circuit movement of carrier 90 is permitted because of the configuration of carrier 90 and contact arm 31, together with the construction of means connecting these two elements including torsion spring 94.

Contact arm 31 is maintained in the fully open blow off position of FIG. 6 by transverse anti-rebound latch pin 701 which moves above latching surface 702 inside of notch 703 at the end of contact arm 31 remote from movable contact 30. Pin 701 is part of anti-rebound latch assembly 700 illustrated in FIGS. 11 through 14. Assembly 700 also includes transparent carrier 704 molded of insulating material and having main planar section 705 from which spaced walls 706, 707 extend forwardly. Each wall 706, 707 is provided with an elongated slot 708 which extends forward from opening 709 in main section 705. The ends of latch pin 701 are disposed in slots 708, 708 and pin 701 is biased against the forward closed ends of slots 708 by the arms of inverted generally U-shaped wire spring 710. The web of spring 710 is captured against the forward surface of main section 705 by being inserted between integral formations 711, 711 which are hot staked after insertion of Spring 710. After the ends of latch pin 701 are entered into guide slots 708, opening 709 is closed by transparent plastic cover 712 which is ultrasonically welded in place.

Figure 3:
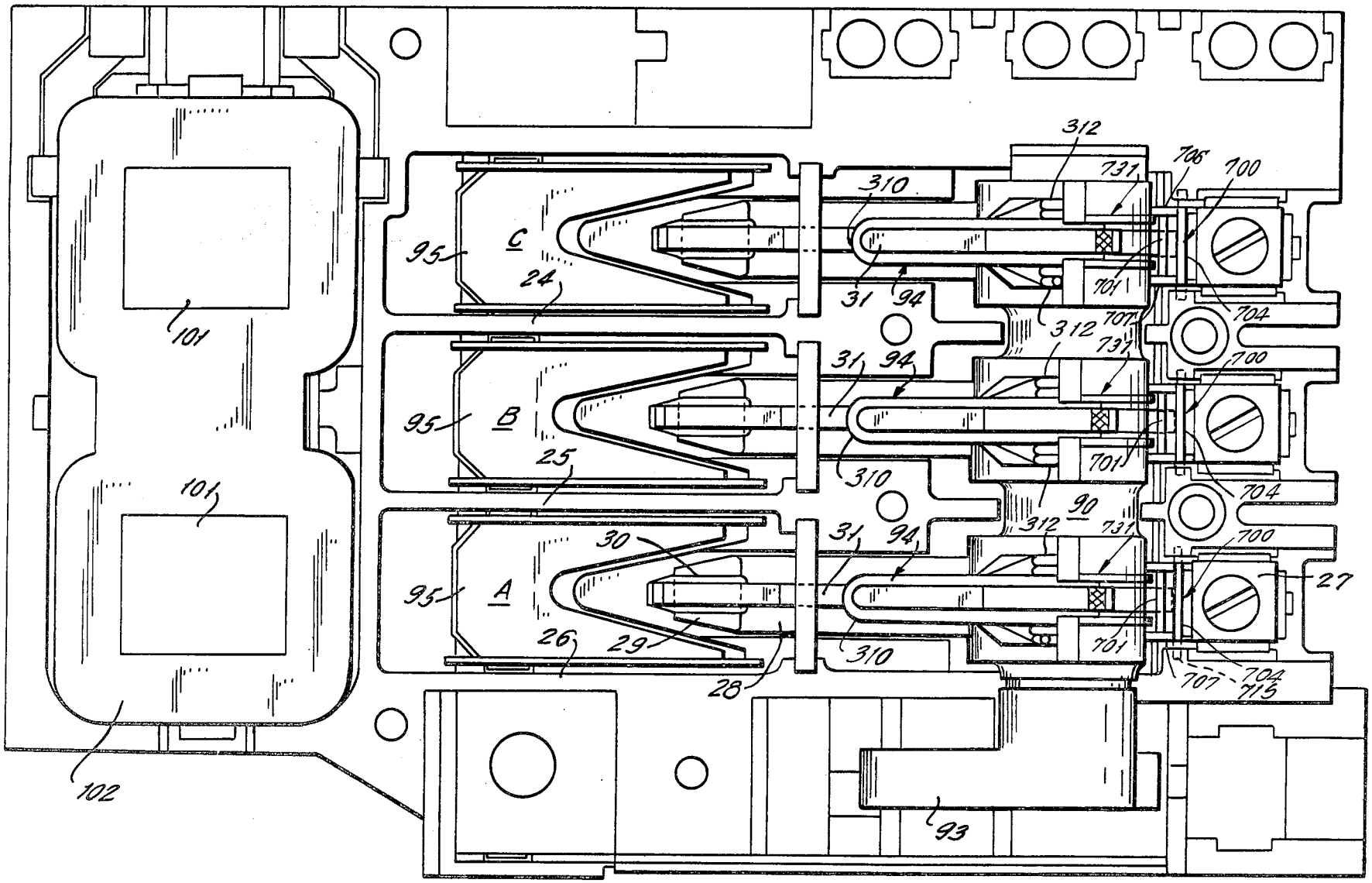
FIG. 3 is a cross-section taken through lines 3—3 of FIG. 2 looking in the direction of arrows 3—3.

Assembly 700 is mounted in its operative position adjacent wire grip 27 by having the side edges 714, 714 of main section 705 inserted into slots 715 (FIG. 3) in base 21. Slots 715 are formed in base ribs 24, 25, 26 and elsewhere. Assemblies 700 act as transverse barriers for the elongated compartments in base 21 for each pole in the circuit 59 breaker portion of combination unit 20.

Figure 5:
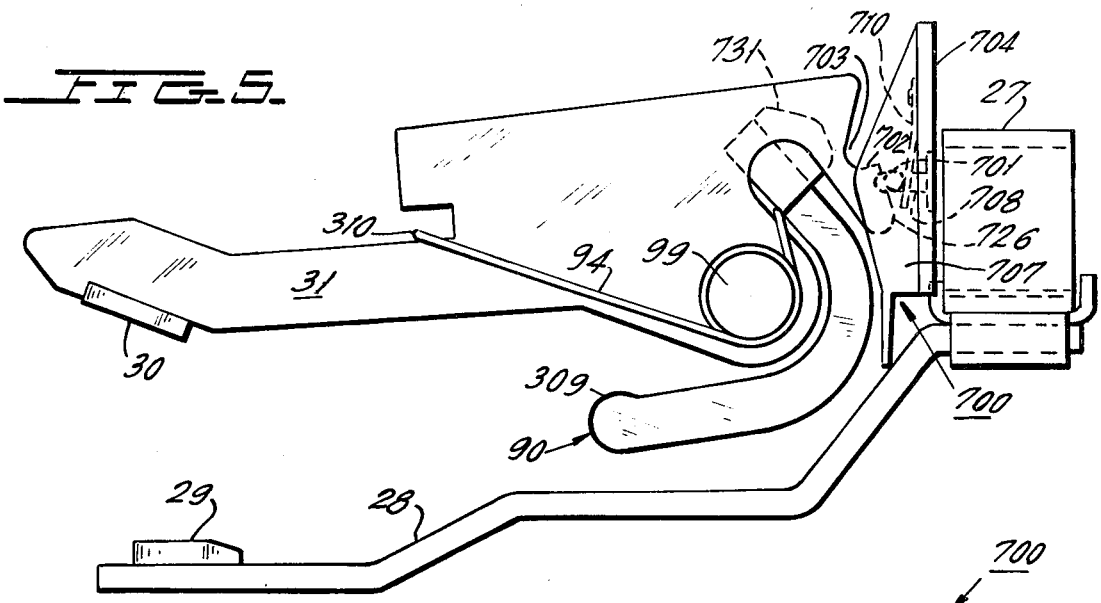
FIG. 5 is a fragmentary view showing the contacts of one pole in a partially open position as a result of electrodynamic blowoff forces.

Now referring more particularly to FIGS. 5 through 7. When contact arm 31 is blown open by electrodynamic forces, even though arm 31 moves toward open circuit position, contact carrier 90 remains in the closed circuit position of FIG. 2. As contact arm 31 moves to the intermediate open position of FIG. 5, camming surface 726 at the right end of contact arm 31 engages anti-rebound latch pin 701 forcing it to the right with respect to FIG. 2 against the force of biasing spring 710. Once the upper end of surface of 726 moves below pin 701 the force of spring 710 moves pin 701 into notch 703 (FIG. 6). Now the cooperation between pin 701 and latching surface 702 locks arm 31 against counterclockwise or rebound movement regardless of the opening speed for the latter.

Pin 701 remains in the latching position of FIG. 6 until contact carrier 90 moves to its open circuit or relatch position of FIG. 7. During this motion of carrier 90 to its open circuit position, release cam formations 731 on contact carrier 90 cams latch pin 701 to the right with respect to FIG. 6, to the unlatched position of FIG. 7. When in the position of FIG. 7, pin 701 is essentially outside of notch 703 and is held in this position during closing by cam surface 726, thereby permitting contact arm 31 to follow contact carrier 90 counterclockwise for closing of circuit breaker 59.

For more detailed descriptions of certain elements illustrated in the drawings, reference is made to one or more of the following copending U.S. Pat. applications Ser. Nos. 681,243, 681,244, 681,245, 681,250 and 681,253, all filed on Apr. 28, 1976.

Although a preferred embodiment of this invention has been described, many variations and modifications will now be apparent to those skilled in the art, and it is therefore preferred that the instant invention be limited not by the specific disclosure herein but only by the appending claims.

What is claimed is:

1. A switching device including a stationary contact, a movable contact, a movable contact arm carrying said movable contact at one end thereof, a carrier to which said arm is mounted, means mounting said carrier for movement between first and second positions wherein said contacts are normally closed and opened, respectively, means mounting said arm on said carrier for relative movement with respect thereto between third and fourth positions while said carrier is in said first position, said contacts being engaged when said carrier is in said first position and said arm is in said third position, biasing means urging said arm toward said third position, latch means to prevent rebound of said arm toward said third position after predetermined movement thereof toward said fourth position as a result of electrodynamic blowoff forces, said latch means including a latch member biased toward normal latching position to engage a latching surface on said arm at its other end to hold said arm in said fourth position, means on said carrier engageable with said latch member to disengage the latter from said latching surface as said carrier moves from said second position toward said first position.

2. A switching device as set forth in claim 1 in which there is a pivot means mounting said arm to said carrier for pivotal movement in a plane normal to an axis defined by said pivot means, said latch member being mounted for movement in a direction generally parallel to said plane.

3. A switching device as set forth in claim 2 in which the latch member comprises a pin parallel to and laterally spaced from said axis.

4. A switching device as set forth in claim 1 in which the means on said carrier for disengaging said latch member from said latching surface is comprised of a first cam surface, a second cam surface on said arm engageable with said latch member for moving the latter against the force of its biasing means as the arm moves toward said fourth position until said latching surface reaches said latch member.

5. A switching device as set forth in claim 3 in which there is a stationary support to which said pin and its biasing means are mounted, said support together with said pin and its said biasing means constituting at least some portions of a subassembly which is held in internal grooves of a switching device housing.

6. A switching device as set forth in claim 5 also another stationary contact, another movable contact, another movable contact arm carrying said another movable contact at one end thereof, means mounting said another arm on said carrier for relative movement with respect thereto between third and fourth positions while said carrier is in said first position, said another contact normally being closed when carrier is in said first position and normally being open when said carrier is in said second position, said another contact being engaged when said carrier is in said first position and said another arm is in its said third position, another biasing means urging said another arm toward its said third position, another latch means to prevent rebound of said another arm toward its said third position after predetermined movement thereof toward its said fourth position as a result of electrodynamic blowoff forces, said another latch means including another latch member biased toward normal latching position to engage a latching surface on said another arm at its other end to hold said another arm in its said fourth position, another means on said carrier engageable with said another latch member to disengage the latter from said latching surface of said another arm as said carrier moves from said second position toward said first position.

7. A switching device as set forth in claim 6 in which said another latch member is part of another subassembly that is of a construction identical to that of said subassembly, a housing including first and second parallel elongated chambers, said movable contact arm and current carrying members associated therewith disposed within said first chamber, said another movable contact arm and its associated current carrying members being disposed within said second chamber, said subassembly and said another subassembly being disposed in and constituting transverse barriers of the respective first and second barriers near the same end of each of said barriers.

8. A switching device as set forth in claim 7 also including a single rod constituting the means mounting both said arm and said another arm on said carrier.

* * * * *